US008335445B2

(12) United States Patent
Uetake et al.

(10) Patent No.: US 8,335,445 B2
(45) Date of Patent: Dec. 18, 2012

(54) DEVELOPMENT APPARATUS AND IMAGE FORMING APPARATUS

(75) Inventors: Shigeo Uetake, Takatsuki (JP); Toshiya Natsuhara, Takarazuka (JP); Junya Hirayama, Takarazuka (JP); Takeshi Maeyama, Ikeda (JP); Makiko Watanabe, Uji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 356 days.

(21) Appl. No.: 12/731,316

(22) Filed: Mar. 25, 2010

(65) Prior Publication Data

US 2010/0254725 A1 Oct. 7, 2010

(30) Foreign Application Priority Data

Apr. 1, 2009 (JP) ..... 2009-088885

(51) Int. Cl.
*G03G 15/06* (2006.01)

(52) U.S. Cl. ..... 399/55; 399/88; 399/282; 399/285

(58) Field of Classification Search ..... 399/55, 399/88, 282, 285
See application file for complete search history.

(56) References Cited

U.S. PATENT DOCUMENTS

2006/0222390 A1* 10/2006 Sasaki et al. ..... 399/55
2007/0071505 A1* 3/2007 Do ..... 399/270
2010/0143002 A1* 6/2010 Maeyama et al. ..... 399/281
2010/0183343 A1* 7/2010 Uetake et al. ..... 399/276
2011/0058836 A1* 3/2011 Imura et al. ..... 399/55
2011/0091248 A1* 4/2011 Sawano et al. ..... 399/269
2011/0243615 A1* 10/2011 Sawano ..... 399/279
2011/0299893 A1* 12/2011 Takai et al. ..... 399/285

FOREIGN PATENT DOCUMENTS

JP 59-172662 A 9/1984
JP 2005-037523 A 2/2005

* cited by examiner

*Primary Examiner* — Walter L Lindsay, Jr.
*Assistant Examiner* — Benjamin Schmitt
(74) *Attorney, Agent, or Firm* — Brinks Hofer Gilson & Lione

(57) ABSTRACT

Provided are a development apparatus and an image forming apparatus which, in a hybrid development apparatus provided with a plurality of toner carriers, a toner supply capability to supply toner to each toner carrier is controlled independent of development electric fields between the toner carriers and an image carrier, whereby each toner carrier is allowed to exhibit a desired development capability, and even in the case of high speed development, a high quality image is provided. The phases, the frequencies, and/or the duty ratios of the alternating current components of the voltages applied to the plurality of the toner carriers are made to be different, whereby the toner supply amount for each toner carrier from the developer carrier is controlled independently of the development electric fields between the toner carriers and the image carrier.

7 Claims, 8 Drawing Sheets

DEVELOPMENT APPARATUS AND IMAGE FORMING APPARATUS

This application is based on Japanese Patent Application No. 2009-088885 filed on Apr. 1, 2009, in Japanese Patent Office, the entire content of which is hereby incorporated by reference.

TECHNICAL FIELD

The present invention relates to an image forming apparatus, using an electrophotographic method, such as a copying machine or a printer, and relates to a development apparatus used to develop an electrostatic latent image formed on an image carrier. In particular, the present invention relates to a hybrid development apparatus in which toner is supplied to a plurality of toner carriers from a developer carrier supporting and conveying thereon a developer containing carrier and toner, and then an electrostatic latent image on an image carrier is developed by a plurality of the toner carriers each having a toner layer formed thereon; and an image forming apparatus using the same.

BACKGROUND

Conventionally, a single-component development method only using toner as a developer and a two-component development method using toner and carrier are known as development methods in image forming apparatuses using electrophotographic methods.

In such a single-component development method, toner is commonly passed through a regulation section formed by a toner carrier and a regulation plate pressed against the toner carrier, thereby the toner is charged and a desired toner thin layer can be obtained, resulting in advantages in simplification, miniaturization, and cost reduction of an apparatus.

However, toner deterioration can be easily accelerated due to strong stress caused by such a regulation section, and the charge acceptance of toner can be easily decreased. Further, a regulation member as a charge providing member for a toner and the surface of a toner carrier are contaminated with toner or external additives, whereby charge providing properties for the toner is decreased, whereby the charge amount on the toner is decreased and problems such as fogging are caused. Thereby, the service life of a development apparatus is usually shortened.

In contrast, in a two-component development method, toner is triboelectrically charged by being mixed with carrier, whereby causing small stress, and the carrier has a strong resistance to the contamination with toner or external additives, since the area of carrier surface is large.

However, in such a two-component development method, when an electrostatic latent image on an image carrier is developed, the image carrier surface is brushed with a magnetic brush formed of developer, resulting in such a problem that magnetic brush traces are generated in a developed image. Further, a carrier is easily allowed to adhere to the image carrier, resulting in the problem of image defects.

A so-called hybrid development method as a development method is proposed (refer to, for example, Unexamined Japanese Patent Application Publication No. 59-172662) to solve such an image defect problem and to realize high image quality comparable to that of a single-component development method while the service life is as long as a two-component development method using a two-component developer, in which hybrid development method a two-component developer is supported on a developer carrier and only toner is supplied from the two-component developer to a toner carrier for development.

However, in such a hybrid development method, when an image is formed at a high speed, the flying of toner is not short enough for a shorter development nip time, resulting in such a problem that image density is decreased.

The above problem is in common with noncontact single-component development. However, it has not seen as a serious problem, since it has been used only in a slow speed region to avoid a problem of heat generation at a regulation section or a problem of toner fusion.

In hybrid development, these problems do not exist, whereby image formation can be carried out at a substantially high speed. However, for example, in an apparatus having a system speed of more than 500 mm/s, there is a possibility that the above problems are produced.

As a countermeasure against the density decrease at such a high speed of development, a method is known, in which a plurality of toner carriers are provided to lengthen the development time for toner flying to ensure toner density (for example, refer to Unexamined Japanese Patent Application Publication No. 2005-37523).

In this configuration, even when a photoreceptor is rotated at a high speed, due to the existence of a plurality of toner carriers, a toner can be flown more than once, whereby the nip width to form a toner image on the photoreceptor is increased, resulting in an advantage to inhibit the density decrease of the toner image associated with higher speed production.

In Unexamined Japanese Patent Application Publication No. 2005-37523, used is an image forming process in which an electrostatic latent image is formed, on an image having been developed on an image carrier, to be developed with different color toner, whereby a plurality of toner images are superimposed on the image carrier. Therefore, it is important that a toner image formed on the upstream side is not disturbed. In order to control toner reciprocation in the development nip and to ensure adequate toner density, emphasis is made on the utilization of a development nip width increased by using a plurality of toner carriers. It is disclosed that it is desirable to further enhance the development capability of a toner carrier of the downstream side than that of a toner carrier of the upstream side in the image carrier rotating direction, in order to realize the above object.

On the other hand, an image forming process is known, in which there is an image forming process to form an image of a plurality of colors, in which process a plurality of steps to transfer a toner image, obtained by developing an electrostatic latent image on an image carrier, onto a recording medium such as an intermediate transfer body or paper are performed.

In this manner, when no toner image is not formed on the upstream side d, it is desirable that toner reciprocation at the development nips is made to be more active and a toner is caused to actively reciprocate in an increased development nip width to enhance uniformity of a toner image in the high speed range and reproducibility of fine dots and thin lines.

Further, since a plurality of such toner carriers are provided, a toner image is formed with the upstream side toner carrier, which is on the upstream side in the rotating direction of the image carrier on which an electrostatic latent image is formed, and whose development capability is enhanced, whereby not only a toner on the toner carrier in the development nip of the downstream side but also a toner image formed on the image carrier by the toner carrier of the upstream side join for toner reciprocation, resulting in more vigorous toner reciprocation.

In such a manner, in a configuration provided with a plurality of toner carriers, the development capability of each of the toner carriers is allowed to vary depending on the intended purpose, whereby advantages thereof can efficiently be effective.

SUMMARY

However, it has been made clear that there is a problem as follows in toner supply from a developer carrier to a toner carrier, in order to enhance the development capability of each toner carrier as described above for different purposes.

It should be noted that in the following description a capability to move toner from a toner carrier to a image carrier for the sake of development is referred to as "toner transfer capability" and a capability to supply toner from a developer carrier to a toner carrier is referred to as "toner supply capability. In a hybrid development method provided with a plurality of toner carriers, a toner is supplied from single developer carrier to the plurality of toner carriers, and then the toner is moved from each toner carrier to an image carrier, whereby an electrostatic latent image on the image carrier is developed into a toner image. In order to supply toner from the developer carrier to the toner carriers, a certain potential difference is formed between the developer carrier and each of the toner carriers.

FIG. 8 shows the relationship among potentials of the developer carrier (Vs), the plurality of toner carriers (Vb1 and Vb2), and the image carrier (image area: Vi).

As obvious from FIG. 8, the potential difference between the developer carrier and the image carrier is constant. Therefore, for example, when the potential difference between the upstream side toner carrier and the image carrier is set large to make the toner transfer capability, to transfer toner to the image carrier, of the upstream side toner carrier large and the potential difference between the downstream side toner carrier and the image carrier is set small to make the development capability, to transfer toner to the image carrier, of the downstream side toner carrier small, the potential difference between the upstream side toner carrier and the image carrier gets small and the potential difference between the downstream side toner carrier and the image carrier gets large.

Thus, the following problem is produced: the toner supply amount to the toner carrier with the enhanced toner transfer capability is small, and the toner supply amount to the toner carrier with the reduced toner transfer capability is large, in which situation the toner carrier with the enhanced toner transfer capability lacks in toner and the toner carrier with the reduced toner transfer capability has excessive toner.

To put it in other words, the constant potential difference between the developer carrier and the image carrier is divided into two parts, one for the development from the toner carrier to the image carrier and the other for the toner supply from the developer carrier to the toner carrier, therefore, it is difficult to set the potential such that the toner transfer capability and the toner supply capability of the same toner carrier are both large or small.

In Unexamined Japanese Patent Application Publication No. 2005-37523, the amplitude of an alternating current voltage applied to the downstream side toner carrier in the rotating direction of the image carrier is set larger than that of an alternating current voltage applied to the upstream side toner carrier, and a decrease in toner supply property to the toner carrier of the downstream side is thus compensated.

However, as described above, from the viewpoint of a high speed response, a toner is desirably reciprocated vigorously at the development nip, and it is not desirable to decrease the alternating electric field at the development nip on even one side.

Further, when a plurality of toner carriers are used to superimpose toner images of a plurality of colors on an image carrier without disturbing the toner image formed by the upstream development device as described in Unexamined Japanese Patent Application Publication No. 2005-37523, its purpose is not sufficiently accomplished because the toner image is disturbed by the increased alternating current electric field between the toner carrier and the image carrier even if the electric field on the downstream side is increased.

The present invention has been completed in view of the above technological problems and backgrounds. An object of the present invention is to provide, in a hybrid development apparatus provided with a plurality of toner carriers, a development apparatus in which the toner supply amount for each toner carrier can be controlled independently of the development electric fields between the toner carriers and an image carrier, the each toner carrier are made to have a desired development capability, and even during high speed development, a high quality image is allowed to be provided; and an image forming apparatus equipped with the development apparatus.

In view of forgoing, one embodiment according to one aspect of the present invention is a development apparatus, comprising:

a first toner carrier configured to be disposed facing a rotating image carrier and to develop an electrostatic latent image formed on the image carrier;

a second toner carrier configured to be disposed, facing the image carrier, on a downstream side of a rotating direction of the image carrier, and to develop the electrostatic latent image;

a developer carrier for carrying developer containing toner and carrier and for supplying the toner to the first toner carrier and the second toner carrier; and a power supply for supplying a first voltage containing a first alternating current component to the first toner carrier, for supplying a second voltage containing a second alternating current component to the second toner carrier, and for supplying a developer carrier bias voltage containing a third alternating current component to the developer carrier, wherein fractions of the following two durations are different:

a first duration in which the first voltage is higher than or equal to an average value thereof and the developer carrier bias voltage is lower than or equal to an average thereof, or the first voltage is lower than or equal to the average thereof and the developer carrier bias voltage is higher than or equal to the average thereof; and a second duration in which the second voltage is higher than or equal to an average thereof and the developer carrier bias voltage is lower than or equal to the average thereof, or the second voltage is lower than or equal to the average thereof and the developer carrier bias voltage is higher than or equal to the average thereof.

According to another aspect of the present invention, another embodiment is an image forming apparatus, comprising:

an image carrier configured to rotate and carry an electrostatic latent image formed thereon; and a development apparatus for developing the electrostatic latent image with toner, the development apparatus including:

a first toner carrier which is disposed facing the image carrier to develop the electrostatic latent image;

a second toner carrier which is disposed, facing the image carrier, on a downstream side of a rotating direction of the image carrier to develop the electrostatic latent image;

a developer carrier for carrying developer containing toner and carrier and for supplying the toner to the first toner carrier and the second toner carrier; and a power supply for supplying a first voltage containing a first alternating current component to the first toner carrier, for supplying a second voltage containing a second alternating current component to the second toner carrier, and for supplying a developer carrier bias voltage containing a third alternating current component to the developer carrier, wherein fractions of the following two durations are different:

a first duration in which the first voltage is higher than or equal to an average value thereof and the developer carrier bias voltage is lower than or equal to an average thereof, or the first voltage is lower than or equal to the average thereof and the developer carrier bias voltage is higher than or equal to the average thereof; and a second duration in which the second voltage is higher than or equal to an average thereof and the developer carrier bias voltage is lower than or equal to the average thereof, or the second voltage is lower than or equal to the average thereof and the developer carrier bias voltage is higher than or equal to the average thereof.

DETAILED DESCRIPTION OF THE PREFERRED EMBODIMENT

One embodiment of the present invention will now be described with reference to drawings.

(Constitution and Operation of an Image Forming Apparatus)

Figure 1:
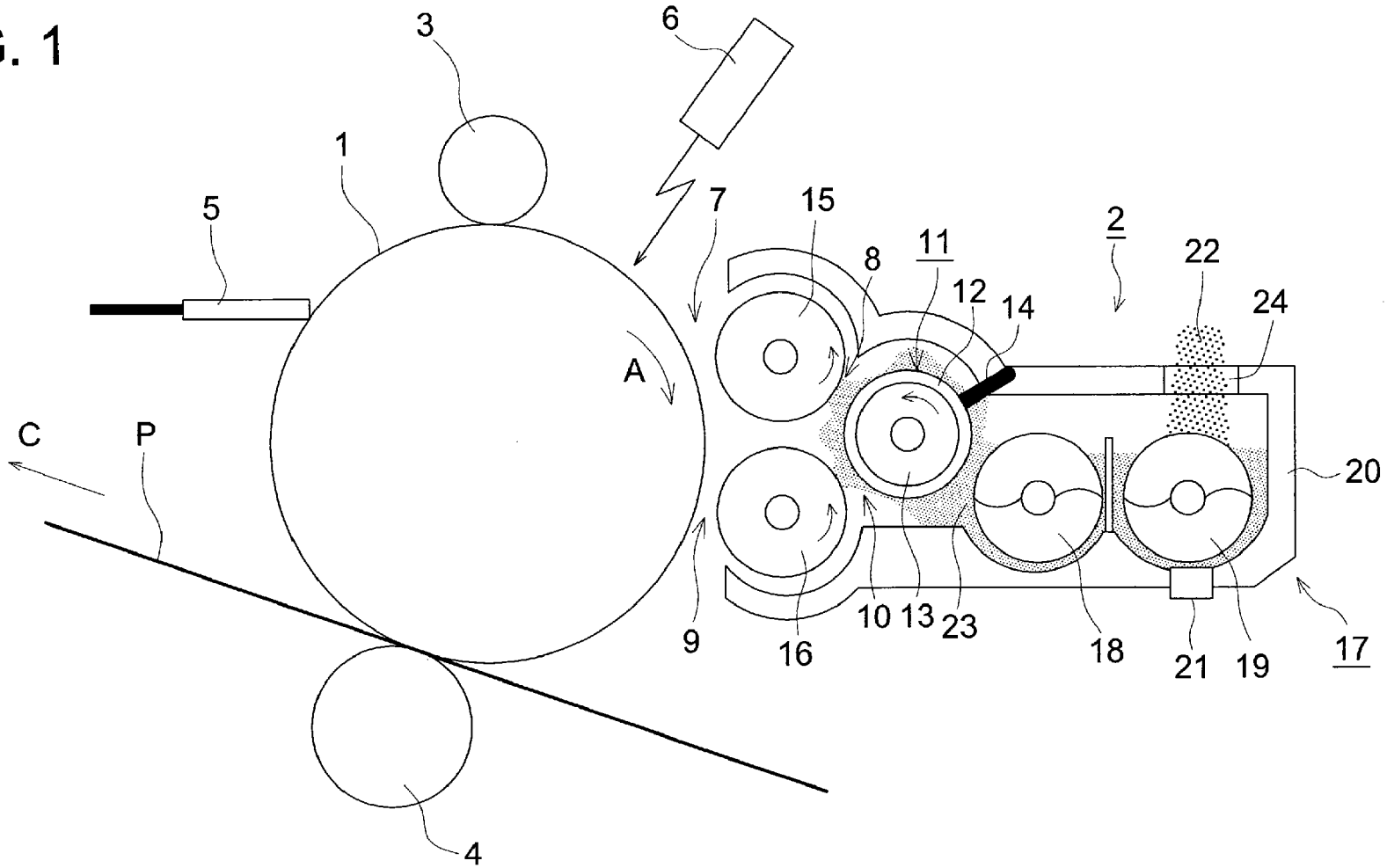
FIG. 1 is a view showing a constitution example of a main section of an image forming apparatus according to the present embodiment.

FIG. 1 shows a constitution example of a main section of an image forming apparatus according to one embodiment of the present invention. With reference to FIG. 1, a schematic constitution and operation of an image forming apparatus according to the present embodiment will be described.

This image forming apparatus is a printer carrying out image formation by transferring a toner image formed on image carrier (photoreceptor) 1 by an electrophotographic system onto transfer medium P such as paper.

This image forming apparatus has image carrier 1 to support an image. In the periphery of image carrier 1, there are arranged, in a sequential order along rotating direction A of image carrier 1, charging member 3 as a charging member to charge image carrier 1; development apparatus 2 to develop an electrostatic latent image on image carrier 1; transfer roller 4 to transfer a developed toner image on image carrier 1; and cleaning blade 5 to remove the residual toner on image carrier 1 after transfer.

Image carrier 1 is charged by charging member 3 and exposed by exposure apparatus 6 provided with a laser emitting device to form an electrostatic latent image on the surface thereof. Development apparatus 2 develops this electrostatic latent image into a toner image. Transfer roller 4 transfers the toner image on image carrier 1 onto transfer medium P, followed by transfer medium P being conveyed in the direction of arrow C of the drawing.

A toner image on transfer medium P is fixed by a fixing apparatus (not shown), and the transfer medium is then discharged. Cleaning blade 5 removes the residual toner, after transfer, on image carrier 1 using a mechanical force.

As image carrier 1, charging member 3, exposure apparatus 6, transfer roller 4, and cleaning blade 5 used in such an image forming apparatus, any well-known technologies of the electrophotographic method can be appropriately employed. For example, a charging roller is illustrated as a charging member in the drawing, but other charging apparatus can be used not in contact with image carrier 1. Further, for example, cleaning blade may not be included.

Next, the constitution of a fundamental section of development apparatus 2, of the hybrid development method, used in the present embodiment will be described.

Development apparatus 2 has the following constitutional elements: developer tank 17 accommodating developer 23 containing carrier and toner; developer carrier 11 conveying thereon developer 23 supplied from developer tank 17; and first toner carrier 15 and second toner carrier 16 both for developing an electric latent image formed on the image carrier 1, to which toner carriers only toner is supplied from the developer carrier 11.

The detailed constitution and operation of development apparatus 2 will be described later.

(Composition of Developer)

The composition of a developer used in the development apparatus according to the present embodiment will now be described.

Developer 23 used in the present embodiment contains toner and carrier to charge the toner.

<Toner>

The toner is not specifically limited, and any well-known and commonly used toner can be employed. Usable are binders that contain colorant, and if desired, charge control agent or releasing agent, and are treated with external additive. Toner particle diameter is preferably about 3-15 μm without being limited thereto.

To produce such toner, production can be carried out by any well-known method being commonly used. The production can be performed, for example, using a pulverization method, an emulsion polymerization method, or a suspension polymerization method.

A binder resin used for a toner is not limited, including, for example, a styrene-based resin (homopolymer or copolymer containing styrene or styrene substitution product), polyester resin, epoxy-based resin, vinyl chloride resin, phenol resin, polyethylene resin, polypropylene resin, polyurethane resin, and silicone resin. It is preferable to use those, obtained using a single body or a complex body of these resins, having a softening temperature of 80-160° C. and a glass transition point of 50-75° C.

Further, as colorant, commonly used and well-known colorant can be used. Usable are, for example, carbon black, aniline black, activated carbon, magnetite, benzene yellow, permanent yellow, naphthol yellow, phthalocyanine blue, first sky blue, ultramarine blue, rose bengal, and lake red. It is typically preferable to use the colorant at a ratio of 2-20% by mass of the binder resin.

Also as the charge control agent, well-known charge control agent can be used. Charge control agent for positive charge toner includes, for example, nigrosine-based dye, quaternary ammonium chloride-based compound, triphenylmethane-based compound, imidazole-based compound, and polyamine resin. Charge control agent for negative charge toner includes, for example, azo-based dye containing metal such as Cr, Co, Al, or Fe, salicylic acid metal compound, alkyl salicylate metal compound, and calixarene compound. It is typically preferable to use such charge control agent at a ratio of 0.1-10% by mass of the binder resin.

Further, also as the releasing agent, commonly used and well-known releasing agents can be used. For example, polyethylene, polypropylene, carnauba wax, and Sasol wax can be used individually or in combination of at least 2 kinds it is typically preferable to use at a ratio of 0.1-10% by mass of the binder resin.

Still further, also as the external additive, commonly used and well-known external additives can be used. For example, inorganic fine particles such as silica, titanium oxide, or aluminum oxide and fine particles of resin such as acrylic resin, styrene resin, silicone resin, or fluorine resin are usable. Those hydrophobized with silane coupling agent, titanium coupling agent, or silicone oil are specifically preferably used. Such fluidizer is used being added at a ratio of 0.1-5% by mass of the toner. The number average primary particle diameter of the external additive is preferably 10-100 nm.

Yet further, as the external additive, reverse polarity particles, which exhibit reverse polarity chargeability with respect to toner charge, may be used. Such reverse polarity particles preferably used are appropriately selected depending on the charge polarity of toner.

When negative charge toner is used as toner, fine particles exhibiting positive chargeability are used as reverse polarity particles. Usable materials include, for example, inorganic fine particles such as strontium titanate, barium titanate, or alumina; and fine particles incorporating thermoplastic resin or a thermosetting resin such as acrylic resin, a benzoguanamine resin, nylon resin, polyimide resin, or polyamide resin. It is also possible to incorporate a positive charge control agent providing positive chargeability in such resin or to form copolymer of nitrogen-containing monomers.

As the above positive charge control agent, For example, nigrosine dye and quaternary ammonium salt can be used. As the nitrogen-containing monomer, Usable materials include, for example, 2-dimethylamino ethyl acrylate, 2-diethylamino ethyl acrylate, 2-dimethylamino ethyl methacrylate, 2-diethylamino ethyl methacrylate, vinylpyridine, N-vinylcarbazole, and vinylimidazole.

On the other hand, when a positive charge toner is used, fine particles exhibiting negative chargeability are used as reverse polarity particles. Usable material include, for example, inorganic fine particles such as silica or titanium oxide, as well as fine particles incorporating thermoplastic resin or thermosetting resin such as fluorine resin, polyolefin resin, a silicone resin, or polyester resin. It is also possible to incorporate negative charge control agent providing negative chargeability in such resin or to form copolymer of fluorine-containing acrylic monomers or fluorine-containing methacrylic resins. As the negative charge control agent, usable materials include, for example, salicylic acid-based or naphthol-based chromium complex, aluminum complex, iron complex, and zinc complex.

To control chargeability and hydrophobicity of reverse polarity particles, the surface of the inorganic fine particles may be treated with silane coupling agent, titanium coupling agent, or silicone oil. Especially when positive chargeability is provided to inorganic fine particles, surface treatment is preferably carried out using amino group-containing coupling agent. In contrast, when negative chargeability is provided, surface treatment is preferably conducted using fluorine group-containing coupling agent.

The number average particle diameter of such reverse polarity particles is preferably 100-1000 nm. Such particles are used being added at a ratio of 1-10% by mass of the toner.

<Carrier>

The carrier is not specifically limited. Any well-known carrier and commonly used carrier can be employed. Binder-type carrier and coat-type carrier can be used. Carrier particle diameter is preferably 15-100 μm without being limited thereto.

The binder-type carrier is a carrier in which magnetic fine particles are dispersed in binder resin. Chargeable fine particles of positive or negative chargeability can be fixed on the carrier surface, or a surface coating layer can also be provided. Charge characteristics, such as polarity, of binder-type carrier can be controlled by a kind of binder resin material, chargeable fine particles, and a surface coating layer.

As a binder resin used for a binder-type carrier, examples include vinyl-based resin represented by polystyrene-based resin; polyester-based resin; nylon-based resin; thermoplastic resin such as polyolefin resin; and curable resin such as phenol resin.

As magnetic fine particles for such binder-type carrier, usable materials include spinel ferrite such as magnetite or gamma ferric oxide; spinel ferrite containing one or at least two kinds of metals (Mn, Ni, Mg, and Cu) other than iron; magnetoplumbite-type ferrite such as barium ferrite; and particles of iron or alloy having an oxide layer on the surface. Shapes of these particles may be any of a granular, spherical, and acicular one. Especially when enhanced magnetization is required, iron-based ferromagnetic fine particles are preferably used. Further, in view of chemical stability, ferromagnetic fine particles such as spinel ferrite containing magnetite or gamma ferric oxide or magnetoplumbite-type ferrite such as barium ferrite are preferably used. By appropriately selecting a kind and content of ferromagnetic fine particles, magnetic resin carrier having desired magnetization can be obtained. Such magnetic fine particles are suitably added in the magnetic resin carrier at an amount of 50-90% by mass.

As surface coating material for binder-type carrier, silicone resin, acrylic resin, epoxy resin, or fluorine-based resin can be used. A coat layer is formed by coating any of these resins on the surface, whereby charge providing performance can be enhanced.

Fixation of chargeable fine particles or electrically conductive fine particles onto the surface of binder-type carrier is carried out, for example, in such a manner that magnetic resin carrier and fine particles are uniformly mixed to adhere these fine particles to the surface of the magnetic resin carrier, and a mechanical or thermal impact is applied to drive the fine particles into the magnetic resin carrier for fixation. In this case, the fine particles are not completely buried in the magnetic resin carrier, and fixed with a part thereof protruded from the surface of the magnetic resin carrier.

As such chargeable fine particles, organic and inorganic insulating materials are used. Specifically as organic materials, usable materials include organic insulating fine particles such as polystyrene, styrene-based copolymer, acrylic resin, various types of acrylic copolymers, nylon, polyethylene, polypropylene, fluorine resin, and linked products thereof. With regard to charge level and polarity, charge of a desired level and polarity can be obtained depending on the material, polymerization catalyst, and surface treatment. Further, as inorganic materials, usable materials include inorganic fine particles of negative chargeability such as silica and titanium dioxide and inorganic fine particles of positive chargeability such as strontium titanate or alumina.

On the other hand, the coat-type carrier is a carrier in which carrier core particles incorporating a magnetic material are resin-coated. Also in the coat-type carrier, similarly to the binder-type carrier, chargeable fine particles of positive or negative chargeability can be fixed onto the carrier surface. Charge characteristics, such as polarity, of the coat-type carrier can be controlled by a kind of a surface coating layer and chargeable fine particles. The same materials for the binder-type carrier can be used. Especially as coating resin, resin similar to binder resin for the binder-type carrier is usable.

The mixing ratio of toner and carrier only has to be adjusted to obtain a desired toner charge amount. The toner mixing ratio is typically 3-50% by mass, preferably 6-30% by mass, based on the total amount of the toner and the carrier.

(Constitution and Operation of Development Apparatus 2)

Figure 2:
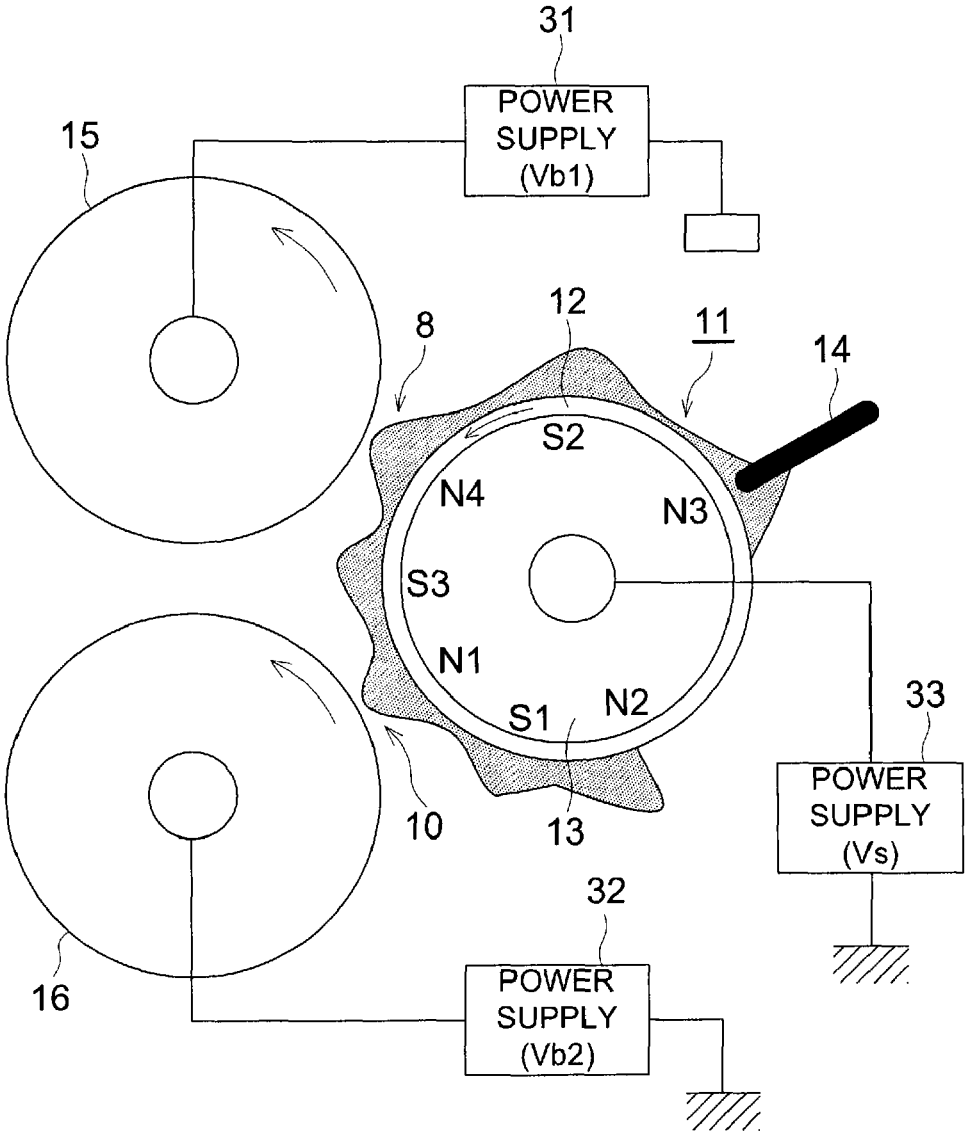
FIG. 2 is an enlarged constitution view of a part of development apparatus 2 in FIG. 1.

FIG. 2 is an enlarged constitution view of a part of development apparatus 2 in FIG. 1. With reference to FIG. 1 and FIG. 2, a detailed constitution example and a detailed operation example of development apparatus 2 according to the present embodiment will now be described.

<Apparatus Constitution>

Developer 23 used in development apparatus 2 contains toner and carrier as described above, being accommodated in developer tank 17.

Developer tank 17 is formed of casing 20, and therein, mixing/stirring members 18 and 19 are housed. Mixing/stirring members 18 and 19 mix and stir developer 23 to supply developer 23 to developer carrier 11. In the position opposite to mixing/stirring member 19 of casing 20, ATDC (Automatic Toner Density Control) sensor 21 for toner density detection is preferably arranged.

Development apparatus 2 typically has replenishment section 24 to replenish an amount of toner to be consumed in development areas 7 and 9 into developer tank 17. In replenishment section 24, replenishment toner 22 sent from a hopper (not shown) accommodating the replenishment toner is replenished into developer tank 17.

Developer carrier 11 incorporates magnetic body 13 fixedly arranged in the interior and rotatable sleeve roller 12 surrounding the magnetic body. Developer 23 supplied to developer carrier 11 is supported on the surface of sleeve roller 12 by the magnetic force of magnetic body 13 inside developer carrier 11, and then conveyed with rotation of the sleeve roller. Regulation member (regulation blade) 14 arranged opposite to developer carrier 11 regulates the amount of toner to pass.

Magnetic body 13 has seven magnetic poles of N1, S1, N2, N3, S2, N4, and S3 along the rotating direction of sleeve roller 12 (refer to FIG. 2).

Main magnetic pole N1 of the magnetic poles is arranged in the position of first toner supply area 8 facing first toner carrier 15, and another main magnetic pole N1 is arranged in second toner supply area 10 facing second toner carrier 16. Further, homopolar sections N2 and N3 generating a repulsive magnetic field to strip developer 23 on sleeve roller 12 are arranged in the positions facing the interior of developer tank 17.

Toner supply bias voltage Vs is applied to developer carrier 11 by developer carrier bias power supply 33 to supply a toner to first and second toner carriers 15 and 16.

First toner carrier 15 and second toner carrier 16 are arranged each facing both of developer carrier 11 and image carrier 1, with developer development bias voltages Vb1 and Vb2 applied by toner carrier bias power supplies 31 and 32 to develop an electrostatic latent image on image carrier 1.

First toner carrier 15 and second toner carrier 16 can be formed of any material if the above voltages can be applied to them. As an example thereof, a surface-treated aluminum roller such as alumite is cited. In addition, usable material is an electrically conductive substrate such as aluminum which is coated with, for example, resin such as polyester resin, polycarbonate resin, acrylic resin, polyethylene resin, polypropylene resin, urethane resin, polyamide resin, polyimide resin, polysulfone resin, polyether ketone resin, vinyl chloride resin, vinyl acetate resin, silicone resin, fluorine resin; or rubber such as silicone rubber, urethane rubber, nitrile rubber, natural rubber, or isoprene rubber. Coating materials are not limited thereto.

Further, an electrically conductive agent may be added to the bulk or the surface of the above coating layer. The electrically conductive agent includes electron conductive agent and ion conductive agent. As the electron conductive agent, examples include without limitation, carbon black such as Ketjen black, acetylene black, or furnace black and fine particles such as metal powder or metal oxides. As the ion conductive agent, examples include without limitation, cationic compounds such as quaternary ammonium salt, amphoteric compounds, and ionic polymer materials.

Further, an electrically conductive roller made of metal material such as aluminum can be employed.

<Apparatus Operation>

Similarly, with reference to FIG. 1 and FIG. 2, an operation example of development apparatus 2 will now be detailed.

Developer 23 in developer tank 17 is mixed and stirred by rotation of mixing/stirring members 18 and 19, being circularly conveyed in developer tank 17 while triboelectric charging is carried out, and the developer is then supplied to sleeve roller 12 of developer carrier 11.

Developer 23 is held on the surface side of sleeve roller 12 by the magnetic force of magnetic body 13 inside developer carrier 11 and rotationally moved along with sleeve roller 12. Then, the passing amount thereof is regulated by regulation member 14 arranged facing developer carrier 11.

The developer whose passing amount has been regulated by regulation member 14 is conveyed to first toner supply area 8 facing first toner carrier 15.

In first toner supply area 8 which is a facing portion of first toner carrier 15 and developer carrier 11, bristles of developer 23 are formed by main magnetic pole N4 of magnetic body 13. Then, by a force applied to the toner by a toner supply electric field formed according to the potential difference between development bias Vb1 applied to first toner carrier 15 and toner supply bias Vs applied to developer carrier 11, the toner in developer 23 is supplied to first toner carrier 15.

Bias Vb1 (a first voltage superimposed with an alternating current voltage), in which an alternating current voltage is superimposed on a direct current voltage, is applied to first toner carrier 15, and bias Vs, in which an alternating current voltage is superimposed on a direct current voltage, is applied developer carrier 11. An electric field, in which an alternating electrical filed is superimposed on a direct electrical filed, is formed in first toner supply area 8. Biases Vb1 and Vs applied to toner carrier 15 and developer carrier 11 will be detailed later.

Further, in first toner supply area 8, the residual toner after development on first toner carrier 15 is mechanically scraped off by the bristles of developer 23 on developer carrier 11 to be recovered.

Residual developer 23 having been passed through first toner supply area 8 is rotationally moved along with sleeve roller 12 of developer carrier 11, and conveyed to second toner supply area 10 opposite to second toner carrier 16 after passing through magnetic pole S3.

Also in second toner supply area 10, similarly to first toner supply area 8, main magnetic pole N1 of magnetic body 13 forms bristles of developer 23 on developer carrier 11. Then, by a force applied to the toner by an electric field formed according to the potential difference between development bias Vb2 applied to second toner carrier 16 and toner supply bias Vs applied to developer carrier 11, the toner in developer 23 is supplied to second toner carrier 16.

Also in this case, similarly to first toner supply area 8, bias Vb2 (a second voltage superimposed with an alternating current voltage), in which an alternating current voltage is superimposed on a direct current voltage, is applied to second toner carrier 16, and bias Vs, in which an alternating current voltage is superimposed on a direct current voltage, is applied to developer carrier 11. An electric field, in which an alternating electrical filed is superimposed on a direct electrical filed, is formed in second toner supply area 10. Biases Vb2 and Vs applied to toner carrier 15 and developer carrier 11 will be detailed later.

Further, also in second toner supply area 10, similarly to first toner supply area 8, the residual toner after development on second toner carrier 16 is mechanically scraped of by the bristles of developer 23 on developer carrier 11 to be recovered.

In FIG. 1 and FIG. 2, all of the rotating directions of developer carrier 11, first toner carrier 15, and second toner carrier 16 are set so as to be rotated in the same direction. However, both of the toner carriers can be set to be rotated reversely with respect to developer carrier 11, or any one of them can be set to be rotated in the reverse direction.

As in FIG. 1 and FIG. 2, when rotation is made in the same direction, in the facing portion of developer carrier 11 and a set of first and second toner carriers 15 and 16, each thereof is rotated in the opposite direction.

In the hybrid development method, it is important that the toner is supplied after the difference of residual toner between the region from which the toner has been used for development and the region from which the toner has not been used for development, in order to reduce the occurrence of development history (ghost). When counter movement is made in the facing portion of developer carrier 11 and first and second toner carriers 15 and 16, as the relative speed is increased, the mechanical recovery force is further enhanced, resulting in an advantage from the viewpoint of recovering the residual toner after development.

Therefore, it is desirable to set the rotating directions of developer carrier 11 and first and second toner carriers 15 and 16 to be in the counter direction in order to reduce development history (ghost).

In first toner supply area 8, a toner layer supplied onto first toner carrier 15 from developer carrier 11 is conveyed to first development area 7 with the rotation of first toner carrier 15, and consumed for a first step development, being transferred by an electric field formed by development bias Vb1 applied to first toner carrier 15 and a latent image potential on image carrier 1.

In first development area 7, the toner is moved by the electric field in a development gap, for development, defined between first toner carrier 15 and image carrier 1. Thereafter, the toner layer (the residual toner layer after development), from which the toner has been consumed in first development area 7, is conveyed to first toner supply area 8 with the rotation of first toner carrier 15.

Further, in the same manner, in second toner supply area 10, a toner layer supplied onto second toner carrier 16 from developer carrier 11 is conveyed to second development area 9 with the rotation of second toner carrier 16, and consumed for a second step development, being transferred by an electric field formed by development bias Vb2 applied to second toner carrier 16 and a latent image potential on image carrier 1.

Also in second development area 9, similarly to first development area 7, the toner is moved by the electric field in a development gap, for development, defined between second toner carrier 16 and image carrier 1. Thereafter, the toner layer (the residual toner layer after development), from which the toner has been consumed in second development area 9, is conveyed to second toner supply area 10 with the rotation of second toner carrier 16.

Developer 23 having been passed through second toner supply area 10 is further conveyed toward developer tank 17 with the rotation of sleeve 12 and stripped off from developer carrier 11 by a repulsive magnetic field formed by magnetic poles N2 and N3 of magnetic body 13 to be recovered into developer tank 17.

When a replenishment control section (not shown) detects, from an output value of ATDC sensor 21, that the toner density in developer 23 has become down to the minimum toner density to ensure an appropriate image density, replenishment toner 22 stored in the hopper is supplied through toner replenishment section 24 into developer tank 17 by a toner replenishment member (not shown).

(Control of Development Capability of Each Toner carrier by Application of Alternating Current Voltage)

Next, application biases Vb1 and Vb2 for first and second toner carriers 15 and 16, and application bias Vs for developer carrier 11 will be detailed.

<Trade-Off Between Toner Transfer Capability in the Development Area and Toner Supply Capability in the Toner Supply Area>

As already described with reference to FIG. 8, in the conventional art, when a constitution is made using a plurality of toner carriers in the hybrid development method, the relationship among potentials of a developer carrier (potential: Vs), a plurality of toner carriers (potentials: Vb1 and Vb2), and an image carrier (image area potential: Vi) has produced the following problems.

Figure 8:
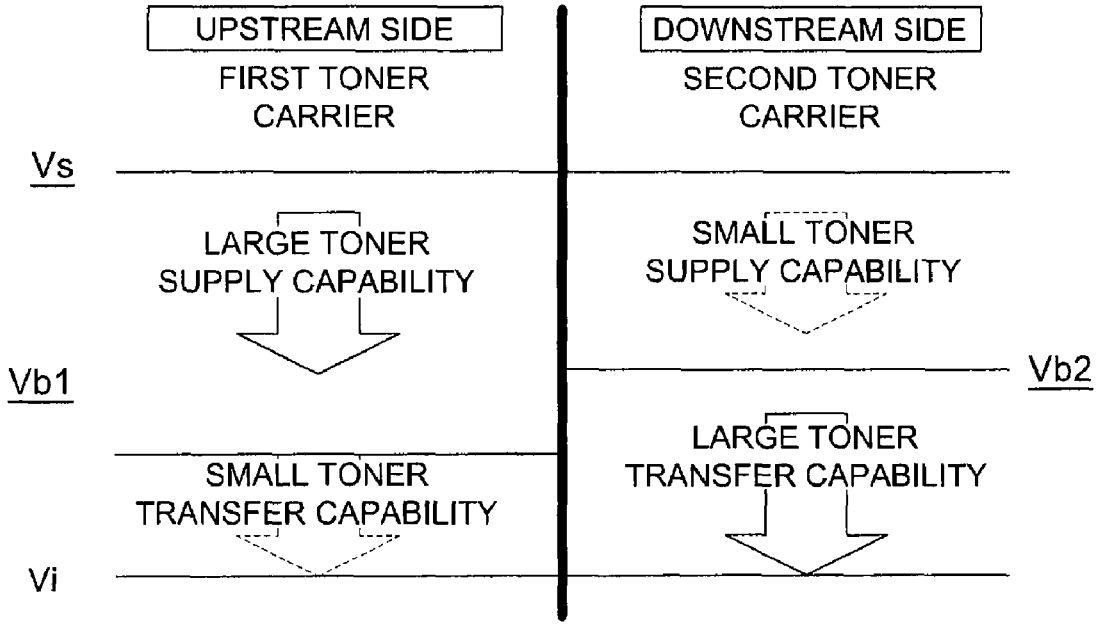
FIG. 8 is an illustration describing a toner supply capability with respect to different bias voltages.

In particular, as obvious from FIG. 8, the potential difference between developer carrier 11 and image carrier 1 is constant. Therefore, for example, when in order to set the toner transfer capability, to transfer toner to the image carrier, of first toner carrier 15 on the upstream side to be large and to set the toner transfer capability, to transfer toner to the image carrier, of second toner carrier 16 of the downstream side to be small, the potential difference between the image carrier (image area potential: Vi) and the toner carrier (potential: Vb1) of the upstream side is set to be large and the potential difference from the toner carrier (potential: Vb2) of the downstream side to be small, the potential difference between the developer carrier (potential: Vs) and the toner carriers (potentials: Vb1)

on the upstream side gets small and the potential difference between the developer carrier (potential; Vs) and the toner carriers (potentials: Vb2) on the downstream side gets large.

Thus, the following problem is produced: the toner amount to be supplied to the toner carrier with the enhanced toner transfer capability to transfer toner to the image carrier is small, and the toner amount to be supplied to the toner carrier of the reduced toner transfer capability to transfer toner to the image carrier is large; in which situation the toner carrier with the enhanced toner transfer capability lacks in toner and the toner carrier with the reduced toner transfer capability has excessive toner for the reduced development capability.

To put it in other words, the potential difference between developer carrier 11 and image carrier 1 is constant, and therefore, this potential difference is divided into to parts: one for development from each of toner carriers 15 and 16 to image carrier 1, and the other for toner supply from developer carrier 11 to each of toner carriers 15 and 16, whereby it is difficult to set potentials so that the toner transfer capability and the toner supply capability for one toner carrier are both large or small.

<Control of Toner Supply Capability Independent of Toner Transfer Capability>

Toner transfer capability and toner supply capability will now be considered.

In FIG. 8, for simplification, the potentials of developer carrier 11, toner carriers 15 and 16 of the upstream and the downstream sides, and image carrier 1 each are allowed to have a constant value (a direct current voltage). And the potential differences among the members each are assumed as toner transfer capability and toner supply capability.

Development and toner supply exactly means nothing but the transferring of charged toner by a potential difference, and therefore, the potential difference is a factor for determining the capabilities of development and supply of toner. When an alternating current voltage is superimposed on a direct current voltage as an application voltage, the potential differences between the members are made not only of a time average value of the applied voltages but also of an instantaneous value of the voltages.

Therefore, even when the time average potential differences are the same, toner transfer capability or toner supply capability can be enhanced by use of the instantaneous value of this superimposed alternating current voltage, more specifically, by increasing the amplitude of the alternating current component of the potential difference.

In the present embodiment, the following setting is made for the relationship among a first voltage superimposed with an alternating current voltage applied to first toner carrier 15 on the upstream side, a second voltage superimposed with an alternating current voltage applied to second toner carrier 16 on the downstream side, and a voltage superimposed with an alternating current voltage applied to developer carrier 11, whereby the toner transfer capability and the toner supply capability of each toner carrier is independently adjusted.

Specifically, the toner supply capabilities are adjusted independently of toner transfer abilities in such a way that the following fractions of the durations are made to be different: the duration in which the alternating current component of the electric field is enhanced in amplitude by Vs applied to the developer carrier and the first voltage superimposed with an alternating current voltage Vbl to have a larger amplitude (the duration in which voltage superimposed with an alternating current voltage Vs is higher than its average Vs and the first voltage superimposed with an alternating current voltage Vb1 is lower than its average Vb1, and vice versa); and the duration in which the alternating component of the electric field is enhanced in amplitude by Vs applied to the developer carrier and the second voltage superimposed with an alternating current voltage Vb2 to have a larger amplitude (the duration in which voltage superimposed with an alternating current voltage Vs is higher than its average Vs and the second voltage superimposed with an alternating current voltage Vb2 is lower than its average Vb2, and vice versa), and thus the toner supply capabilities are adjusted independent of the toner transfer capabilities. Note that based on the above discussion and a review of the remaining parts of the present Specification, one of ordinary skill would readily understand that the use of the term "fraction" throughout the Specification means the ratio of a duration to a common total duration of developing, wherein the duration makes up a portion of the total duration of developing. Thus, the Specification's description above and throughout the Specification regarding two durations in which voltages are superimposed with an alternating current voltage, regards the situation where the two durations make up portions of the total duration of developing.

Specifically, the phases, the frequencies, and the duty ratios of the voltages superimposed with an alternating current voltage each applied as bias to a plurality of toner carriers are made to be different, whereby the toner supply amount from the developer carrier to each toner carrier can be controlled, independently of the development electric field between the toner carrier and the image carrier.

(Setting of Alternating Current Bias Voltage)

In the present embodiment, the toner supply electric fields each formed between bias Vs applied to developer carrier 11 and each of biases Vb1 and Vb2 each applied to each of first and second toner carriers 15 and 16 are allowed to be modified independently of the development electrical fields (time averages of the electric fields and amplitudes of the alternating current components) formed between biases Vb1 and Vb2 each applied to first and second toner carriers 15 and 16 and potential Vi of an electrostatic latent image of image carrier 1, and thus, the toner supply amount for the each toner carrier can be modified to adjust the development capability thereof.

Therefore, in the following description, described is a case in which the development electric fields between image carrier 1 and each of first and second toner carriers 15 and 16 are constant in average and amplitude without being limited thereto. The present invention can also be applied to any cases in which these development electric fields are otherwise modified.

Further, for a simple explanation, the amplitudes of alternating current components and the time averages of Vb1 and Vb2 are assumed to be fixed; the amplitude of the alternating current component of Vs is the same as that of Vb1 and Vb2, and the time average of Vs is shifted and fixed to the toner supply side. However, the scope of the invention is not limited to these values, and they only have to be appropriately set depending on the development gap, the toner supply gap, the resistance of the toner carrier, and the resistance of the developer.

With reference to FIG. 3*a*-FIG. 7*b*, each setting example of Vi (image portion potential), Vb1, Vb2, and Vs in the present embodiment will now be described.

In FIGS. 3*a*, 4*a*, 5*a*, 6*a*, and 7*a*, each setting example of Vi (image portion potential), Vb1, Vb2, and Vs is shown, where a vertical axis represents potential and a lateral axis represents time. In these drawings, the application voltage waveforms each are shown by dashed-dotted lines (Vb1 and Vb2) or a chain line (Vs) and the time average value $\overline{Vs}$, $\overline{Vb1}$, and $\overline{Vb2}$ of each of Vs, Vb1, and Vb2 is shown by a solid line.

In FIGS. 3*b*, 4*b*, 5*b*, 6*b*, and 7*b*, in order to describe the potential difference applied to the toner supply gap when each bias in FIGS. 3*a*, 4*a*, 5*a*, 6*a*, and 7*a* is applied, where a lateral axis represents time. The waveforms of potential differences ΔV1 and ΔV2 between Vs and each of Vb1 and Vb2 are shown by dashed-two dotted lines, and time averages of $\underline{\Delta V1}$ and $\underline{\Delta V2}$ are shown by solid lines.

Setting Example 1

Figure 3A:
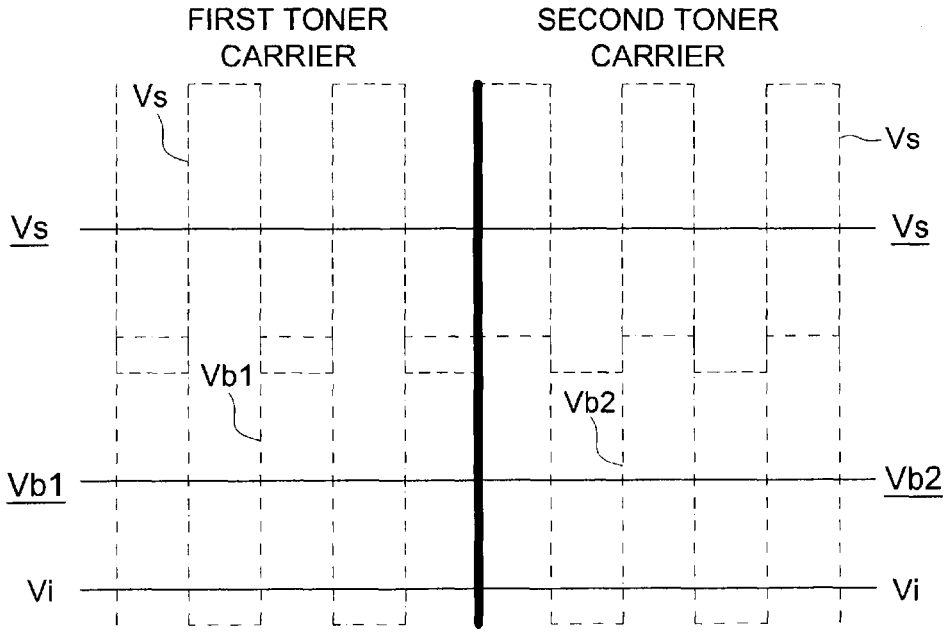
FIGS. 3*a* and 3*b* are illustrations describing (phase-shifted) setting example 1 of each voltage superimposed with an alternating current voltage.

In FIG. 3*a*, there is shown an example where the phases of alternating current bias Vb1 and Vb2 with respect to Vs are different.

As obvious from FIG. 3*a*, an electric field formed by Vb1 and Vi and an electric field formed by Vb2 and Vi are the same in average and amplitude, and the applied bias Vs is the same with respect to both toner carrier since the conductive developer carrier is identical.

Figure 3B:
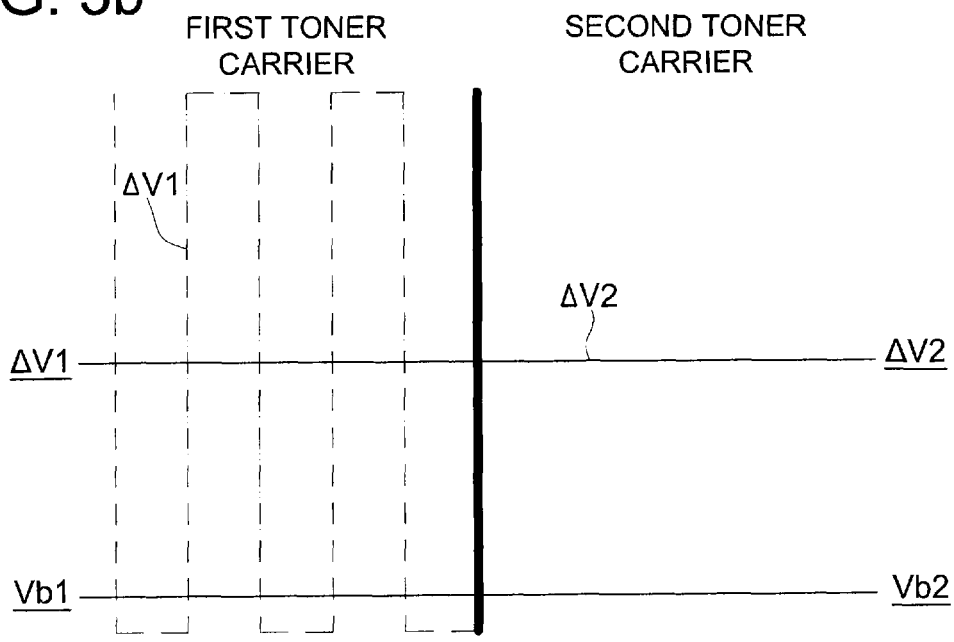

In the example of FIG. 3*a*, the phases of voltages applied to the toner carriers are reversed to each other, where Vb1 has a phase opposite to Vs, and Vb2 has the same phase as Vs. Since the phases of Vb1 and Vb2 are set to be reversed as mentioned above, potential differences ΔV1 and ΔV2 each at each toner supply gap is made as shown in FIG. 3*b*.

Since Vb1 has a phase opposite to Vs, when Vb1 is at its maximum potential, Vs is at its minimum potential, thereby enhancing the alternating current component of the electric field (the amplitude is enhanced), with the amplitude of ΔV1 being the sum of the amplitudes of Vb1 and Vs.

On the other hand, since Vb2 has the same phase as Vs, when Vb2 is at its maximum potential, Vs is also at its minimum potential, thereby reducing the alternating current component of the electric field (canceling each other), with the amplitude of ΔV2 being the difference (completely canceled in this case) between the amplitudes of Vb1 and Vs.

To put it other words, the fractions of the following two durations are set different; the duration in which the first alternating current voltage applied to the first toner carrier and the alternating current voltage applied to the developer carrier enhance the amplitude of the alternating current component of the electric field formed between them (the duration in which voltage superimposed with an alternating current voltage applied to the first toner carrier is higher than its average and the voltage applied to the developer carrier is lower than its average, and vice versa); and the duration in which the second alternating current voltage applied to the second toner carrier and the alternating current voltage applied to the developer carrier reduce the amplitude of the alternating current component of the electric field formed between them (the duration in which voltage superimposed with an alternating current voltage applied to the second toner carrier is higher than its average and the voltage applied to the developer carrier is lower than its average, and vice versa).

AS described above, when the phases of Vb1 and Vb2 are reversed, the toner supply electric fields (the amplitudes of the alternating current components of the electric fields) are modified while each development electric field is not modified, whereby different amount of toner is supplied to each toner carrier.

Thus, without modifying the development electric fields between the image carrier and each toner carrier, modified amount of toner is supplied to the toner carriers, thereby modifying the development capabilities.

In the example of FIGS. 3*a* and 3*b*, setting was made in such a way that the toner supply amount for the first toner carrier on the upstream side is large and its development capability is also large. However, if the phases of Vb1 and Vb2 are turned around, the toner supply amount for the second toner carrier of the downstream side is increased and its development capability is enhanced.

Setting Example 2

Figure 4A:
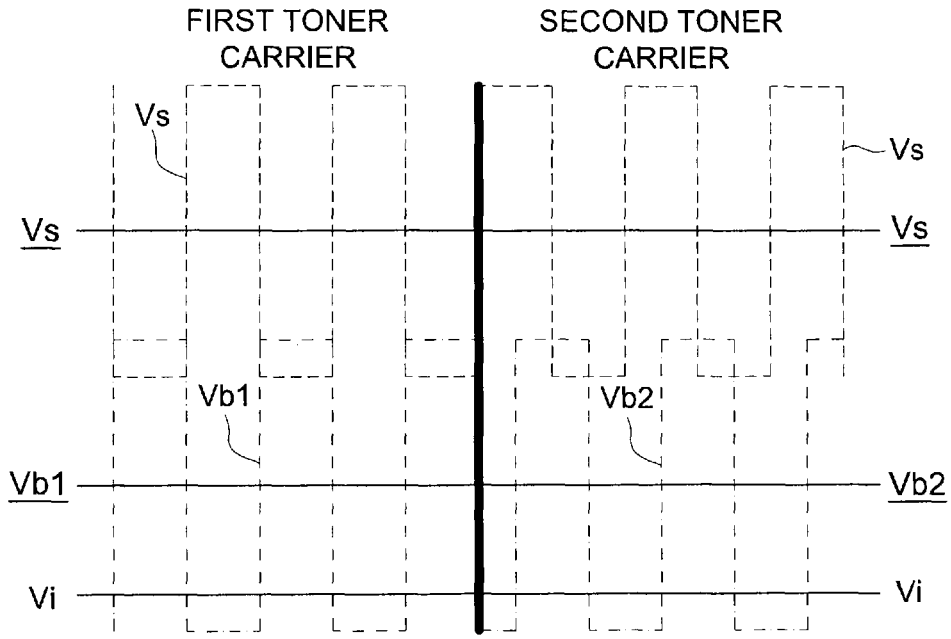
FIGS. 4*a* and 4*b* are illustrations describing (phase-shifted) setting example 2 of each voltage superimposed with an alternating current voltage.

In the same manner, FIG. 4*a* shows an example in which the shifting amount of the phase of Vb2 with respect to Vb1 is changed to 90°.

Figure 4B:
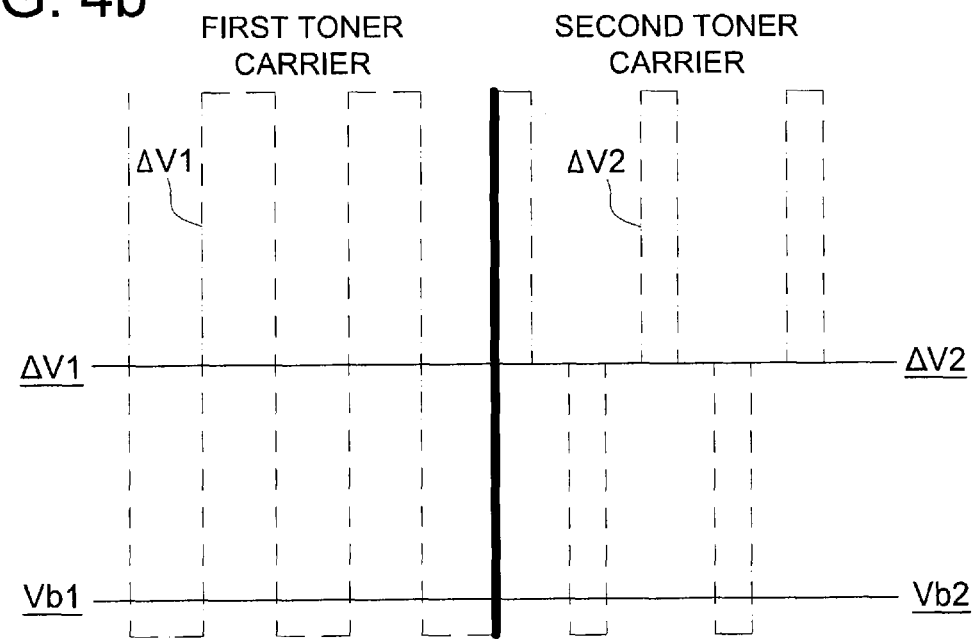

As shown in FIG. 4*b*, in the first toner carrier on the upstream side, the toner supply electric field is always enhanced. In contrast, in the second toner carrier on the downstream side, the duration in which the toner supply electric field is enhanced (the duration of a large amplitude) and the duration in which the toner supply electric field is weakened (the time range of small amplitude) alternately appear.

To put it other words, the fractions of the following two durations are set different; the duration in which the first alternating current voltage applied to the first toner carrier and the alternating current voltage applied to the developer carrier enhance the amplitude of the alternating current component of the electric field formed between them (the duration in which voltage superimposed with an alternating current voltage applied to the first toner carrier is higher than its average and the voltage applied to the developer carrier is lower than its average, and vice versa); and the duration in which the second alternating current voltage applied to the second toner carrier and the alternating current voltage applied to the developer carrier reduce the amplitude of the alternating current component of the electric field formed between them (the duration in which voltage superimposed with an alternating current voltage applied to the second toner carrier is higher than its average and the voltage applied to the developer carrier is lower than its average, and vice versa).

As described in the above example, when the phase is continuously varied, the toner supply electric field (the amplitude of the alternating current component of the electric field) is allowed to be continuously varied. Thus the toner supply amount is continuously varied by continuously changing the phase.

Further, as obvious from FIG. 4*a*, also in this example, the development electric field between Vb1 and Vi and the development electric field between Vb2 and Vi are the same in average and amplitude, while the toner supply amount, hence the development capability, can be controlled independently of the development electric field.

The toner supply electric field (the amplitude of the alternating current component of the electric field) is at its maximum when Vb has a phase opposite to that of Vs (180° phase shifting with respect to Vs). However, it is not necessary that the bias voltage to one of the toner carrier has a 180° phase difference (opposite phase) as shown in FIGS. 4*a* and 4*b*.

Setting Examples 3 and 4

Figure 5A:
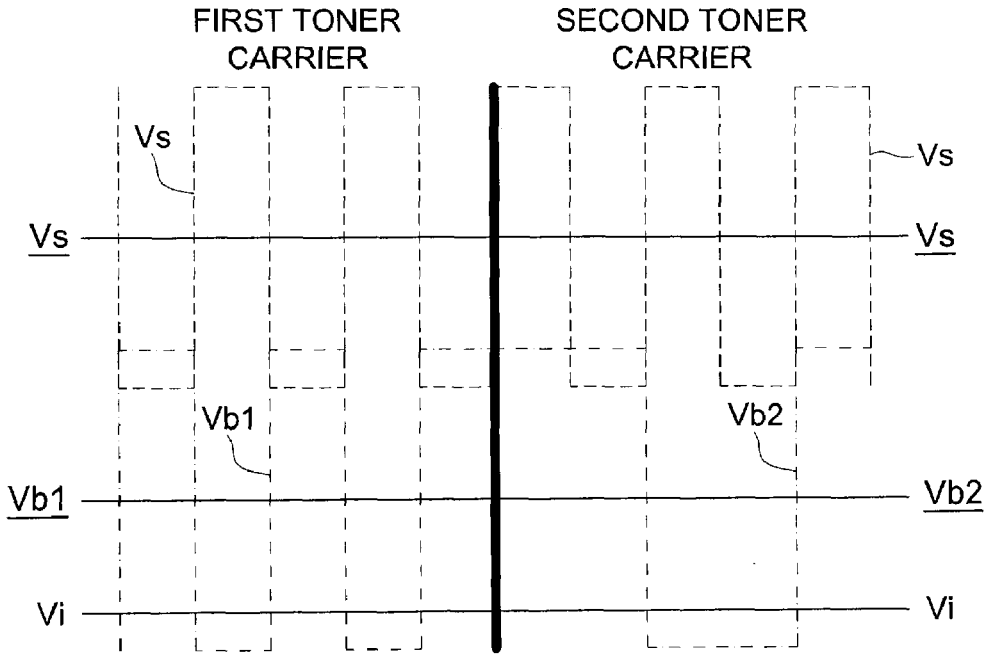
FIGS. 5*a* and 5*b* are illustrations describing (frequency-changed) setting example 3 of each voltage superimposed with an alternating current voltage.
Figure 5B:
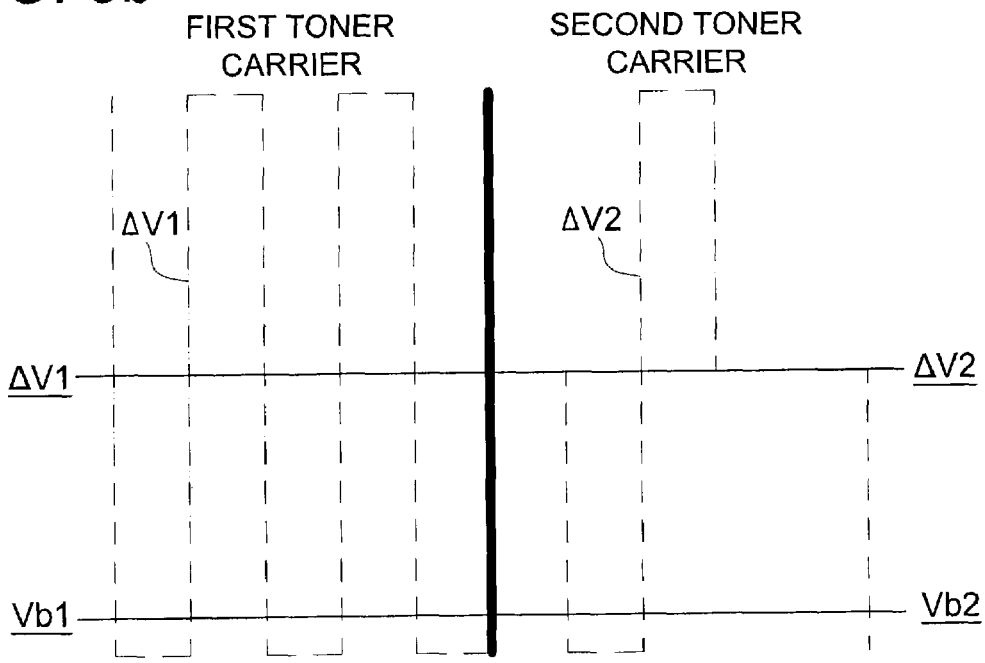
Figure 6A:
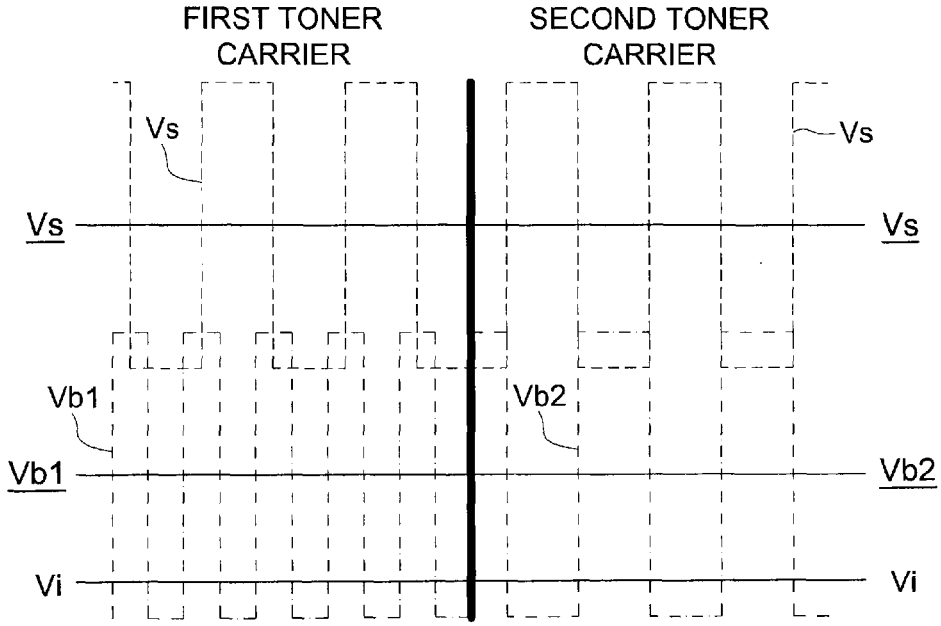
FIGS. 6*a* and 6*b* are illustrations describing (frequency-changed) setting example 4 of each voltage superimposed with an alternating current voltage.
Figure 6B:
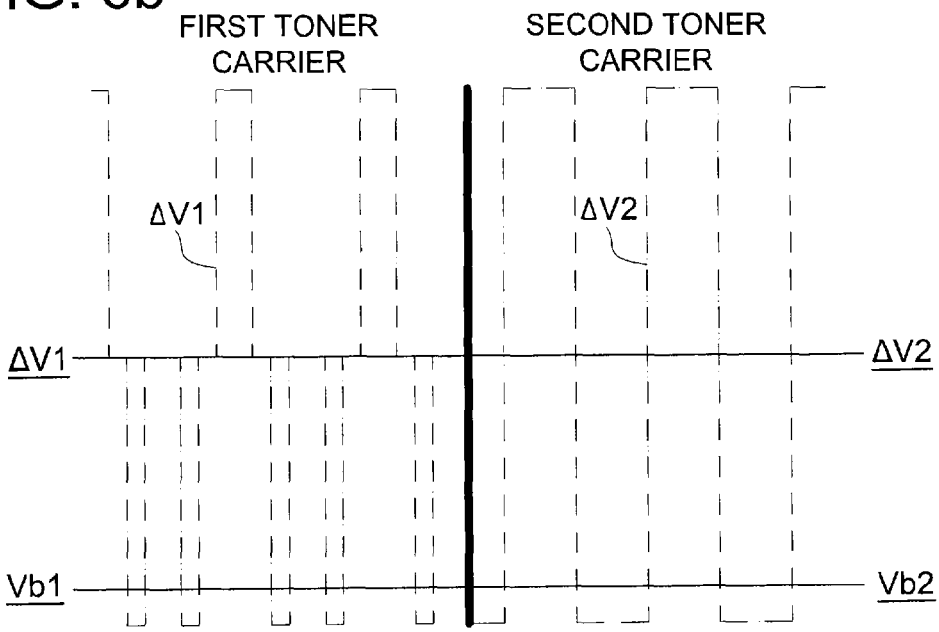

The same effect as the above is produced by modifying the frequency of the alternating current bias. FIGS. 5*a* and 5*b* show an example in which Vs and Vb1 have the same frequency and are opposite in phase, and the frequency of Vb2 is half that of Vb1. In contrast, FIGS. 6*a* and 6*b* show an example in which Vs and Vb2 have the same frequency and are opposite in phase, and the frequency of Vb1 is twice that of Vb2.

Detailed description is omitted because the description will be similar to FIGS. 3*a* and 3*b* and FIGS. 4*a* and 4*b*. In the toner carrier to which a bias voltage with a frequency different from that of Vs, the relationship of enhancing the toner supply electric field and the relationship of reducing the toner supply electric field appear alternately, while such relationships do not appear in the toner carrier to which a bias voltage with the same frequency as that of Vs.

To put it other words, the fractions of the following two durations are set different; the duration in which the first alternating current voltage applied to the first toner carrier and the alternating current voltage applied to the developer carrier enhance the amplitude of the alternating current component of the electric field formed between them (the duration in which voltage superimposed with an alternating current voltage applied to the first toner carrier is higher than its average and the voltage applied to the developer carrier is lower than its average, and vice versa); and the duration in which the second alternating current voltage applied to the second toner carrier and the alternating current voltage applied to the developer carrier reduce the amplitude of the alternating current component of the electric field formed between them (the duration in which voltage superimposed with an alternating current voltage applied to the second toner carrier is higher than its average and the voltage applied to the developer carrier is lower than its average, and vice versa).

Thus, the toner carrier supplied with a frequency different from that of Vs has a smaller amount of toner supply, because that toner carrier has a smaller fraction of duration in which an alternating current component of the electric field with enhanced amplitude than the toner carrier supplied with the same frequency as Vs.

Setting Example 5

Description has been so for made in the case in which voltages in which alternating current voltages having a symmetrical rectangular wave (duty ratio: 50%) are superimposed to direct current voltages are used as Vb1, Vb2, and Vs. However, the wave form of the alternating current voltage to be superimposed to a direct current voltage is not limited thereto, and for example, as shown in FIGS. 7*a* and 7*b*, any rectangular wave having a different duty ratio may be employed.

Figure 7A:
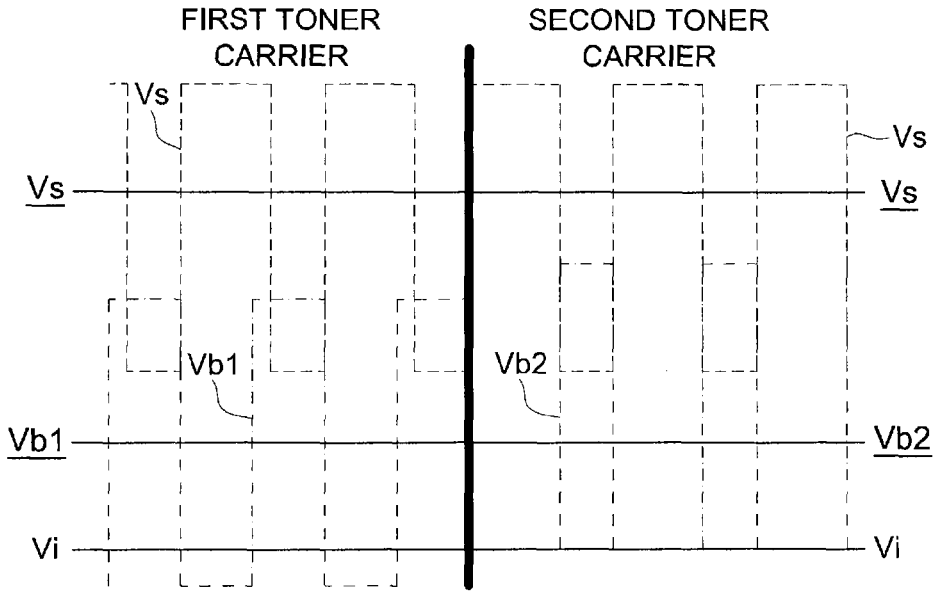
FIGS. 7*a* and 7*b* are illustrations describing (duty-changed) setting example 5 of each voltage superimposed with an alternating current voltage.

In the example of FIG. 7*a*, a rectangular wave of a duty ratio of 60% is applied as Vs, and a rectangular wave having the same frequency as, a phase opposite to, and a duty ratio (duty ratio: 40%) opposite to Vs is applied as Vb2. In contrast, a rectangular wave having a duty ratio of 50% is applied as Vb1.

Figure 7B:
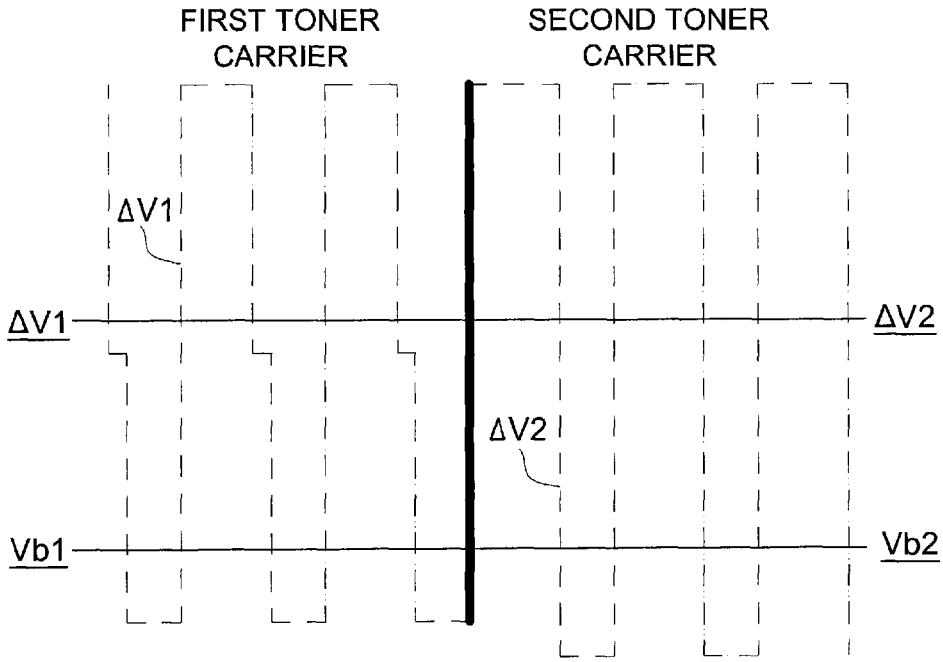

As obvious from the potential difference between the toner carriers and the image carrier shown in FIG. 7*b*, the case where a waveform having the same frequency as, a phase opposite to, and a duty ratio opposite to Vs is applied to the toner carrier is the case where the electrostatic field is mostly enhances, as described above. Taking this condition as a standard, as the duty ratio gets away from the standard, the time in which the electric field between the toner carrier and the image carrier gets shorter.

To put it other words, the fractions of the following two durations are set different; the duration in which the first alternating current voltage applied to the first toner carrier and the alternating current voltage applied to the developer carrier enhance the amplitude of the alternating current component of the electric field formed between them (the duration in which voltage superimposed with an alternating current voltage applied to the first toner carrier is higher than its average and the voltage applied to the developer carrier is lower than its average, and vice versa); and the duration in which the second alternating current voltage applied to the second toner carrier and the alternating current voltage applied to the developer carrier reduce the amplitude of the alternating current component of the electric field formed between them (the duration in which voltage superimposed with an alternating current voltage applied to the second toner carrier is higher than its average and the voltage applied to the developer carrier is lower than its average, and vice versa).

In the example FIGS. 7*a* and 7*b*, the development electric fields between the two toner carriers and the image carrier are not identical in a duty ratio, and the development electric field of the first toner carrier on the upstream side can be set so fogging is easily caused and the development electric field of the second toner carrier on the downstream side can be set so that fogging is recovered. Thus the fogging toner generated on the upstream can be used to activate the toner reciprocation in the development nip on the downstream side. To put it other words, the fogged toner on the background caused in the first development area facilitates the reciprocal motion of toner in the second development area, thus, the reproducibility of isolated fine lines and fine dots are improved. But, it should be noted that the bias condition of the second development area has to be set so as to sufficiently recover the fogged toner caused in the first development area and attached to the background.

For example, when the average values of the first and second voltage are set so that the toner on the first toner carrier receives a larger electric force toward the image carrier than the toner on the second toner carrier, the amount of toner to be supplied to each toner carrier is controlled independently of the development electric fields while the development electric field is kept larger.

Further, as already described, in the image forming process in which a multicolor image is formed by repeating a step in which a toner image formed by developing an electrostatic latent image on an image carrier is transferred to a recoding medium such as an intermediate transfer member or a sheet of paper, it is more preferable that a fraction of duration in which the electric field with an enhanced amplitude of the alternating current component is generated between the first toner carrier and the image carrier is longer than a fraction of duration in which the a electric field with an enhanced amplitude of an alternating current component is generated between the second toner carrier and the image carrier.

That is because in development, when there is no toner image formed on the upstream side (which means the case of developing the first color image), reciprocation of the toner at the development nip can be facilitated to be activated and then the toner is actively reciprocated in the nip having an enlarged width; and uniformity enhancement of a toner image in the high speed range and enhanced reproduction of fine dots and thin lines are expected.

Further, a toner image is formed with the upstream side toner carrier whose development capability is enhanced, whereby not only a toner on the toner carrier in the development nip of the downstream side but also a toner image formed on the image carrier by the toner carrier of the upstream side join for toner reciprocation, resulting in more vigorous toner reciprocation.

The alternating current voltage waveform to be superimposed may be a sine wave or another waveform, which wave forms are not typically used as a development bias. An object of the present embodiment is that in potential differences ΔV1 and ΔV2 between the toner carriers and the developer carrier shown in FIGS. 3*a*-7*b*, an integrated values of one side (the plus or minus polarity side) with respect to time average values are set to be different for ΔV1 and ΔV2; and then the toner supply amount for each toner carrier can be adjusted independently of the development electric fields.

As described above, in a development apparatus according to the present embodiment and an image forming apparatus using the development apparatus, the phases, the frequencies, and/or the duty ratios of the alternating current components of the voltages applied as biases to the plurality of toner carriers are made to be different, whereby the toner supply amount for each toner carrier from the developer carrier can be controlled independently of the development electric fields between the toner carriers and the image carrier.

Thereby, in a hybrid development apparatus provided with a plurality of toner carriers, each toner carrier can be allowed to exhibit a desired development capability, and even during high speed development, a high quality image can be provided.

Adjusting the toner supply amount independently of the development electrical fields can be used for a feedback control depending on a change of development characteristics of a development apparatus caused by a change of the use environment, and on a printing mode or a print rate. Further, it contributes to flexibility in designing apparatuses; for example, a toner supply amount can be stabilized even when an application voltage to form an appropriate development electric field has a deviation from the design value with variations in members.

It should be noted that the above embodiment are only examples in all respects and not restrictive. The scope of the present invention is represented not by the above description but by the scope of the appended claims, and is intended to contain any modification within the scope of the appended claims and within the scope equivalent to the appended claims.

What is claimed is:

1. A development apparatus, comprising:

a first toner carrier configured to be disposed facing a rotating image carrier and to develop an electrostatic latent image formed on the image carrier;

a second toner carrier configured to be disposed, facing the image carrier, on a downstream side of a rotating direction of the image carrier, and to develop the electrostatic latent image;

a developer carrier for carrying developer containing toner and carrier and for supplying the toner to the first toner carrier and the second toner carrier; and a power supply for supplying during a total duration of developing: 1) a first voltage containing a first alternating current component to the first toner carrier, 2) a second voltage containing a second alternating current component to the second toner carrier, and 3) a developer carrier bias voltage containing a third alternating current component to the developer carrier, wherein the total duration of developing comprises a first duration and a second duration and wherein a first fraction defined as a ratio of the first duration to the total duration of developing has a value that is not equal to a second fraction defined as a ratio of the second duration to the total duration of developing:

wherein during the first duration the first voltage is higher than or equal to an average value thereof and the developer carrier bias voltage is lower than or equal to an average thereof, or the first voltage is lower than or equal to the average thereof and the developer carrier bias voltage is higher than or equal to the average thereof; and wherein during the second duration the second voltage is higher than or equal to an average value thereof and the developer carrier bias voltage is lower than or equal to the average thereof, or the second voltage is lower than or equal to the average thereof and the developer carrier bias voltage is higher than or equal to the average thereof.

2. The development apparatus of claim 1, wherein the first alternating current component and the second alternating current component have different phases.

3. The development apparatus of claim 1, wherein the first alternating current component and the second alternating current component have different frequencies, and one of the first alternating current component and the second alternating current component has the same frequency as and an opposite phase to the third alternating current component.

4. The development apparatus of claim 1, wherein the first alternating current component and the second alternating current component are rectangular waves, and have different duty ratios.

5. The development apparatus of claim 1, wherein the first fraction of the first duration is greater than the second fraction of the second duration.

6. The development apparatus of claim 5, wherein the average value of the first voltage and the average value of the second voltage are set so that the toner on the first toner carrier receives a greater electric force toward the image carrier than the toner on the second toner carrier.

7. An image forming apparatus, comprising:

an image carrier configured to rotate and carry an electrostatic latent image formed thereon; and a development apparatus for developing the electrostatic latent image with toner, the development apparatus comprising:

a first toner carrier which is disposed facing the image carrier to develop the electrostatic latent image;

a second toner carrier which is disposed, facing the image carrier, on a downstream side of a rotating direction of the image carrier to develop the electrostatic latent image;

a developer carrier for carrying developer containing toner and carrier and for supplying the toner to the first toner carrier and the second toner carrier; and a power supply for supplying during a total duration of developing: 1) a first voltage containing a first alternating current component to the first toner carrier, 2) a second voltage containing a second alternating current component to the second toner carrier, and 3) a developer carrier bias voltage containing a third alternating current component to the developer carrier, wherein the total duration of developing comprises a first duration and a second duration and wherein a first fraction defined as a ratio of the first duration to the total duration of developing has a value that is not equal to a second fraction defined as a ratio of the second duration to the total duration of developing:

wherein during the first duration the first voltage is higher than or equal to an average value thereof and the developer carrier bias voltage is lower than or equal to an average thereof, or the first voltage is lower than or equal to the average thereof and the developer carrier bias voltage is higher than or equal to the average thereof; and wherein during the second duration the second voltage is higher than or equal to an average value thereof and the developer carrier bias voltage is lower than or equal to the average thereof, or the second voltage is lower than or equal to the average thereof and the developer carrier bias voltage is higher than or equal to the average thereof.

* * * * *